United States Patent [19]

Shishido et al.

[11] 4,237,431

[45] Dec. 2, 1980

[54] FIVE PORT WAVEGUIDE SWITCH

[75] Inventors: Isuneo Shishido, Rancho Palos Verdes; Herman W. Cramm, Rolling Hills Estates; William L. Vick, Yorba Linda, all of Calif.

[73] Assignee: Hughes Aircraft Company, Culver City, Calif.

[21] Appl. No.: 922,896

[22] Filed: Jul. 10, 1978

[51] Int. Cl.[2] ..... H01P 1/10

[52] U.S. Cl. ..... 333/106; 333/108

[58] Field of Search ..... 333/101, 105–108, 333/259

[56] References Cited

U.S. PATENT DOCUMENTS

| | | | |
|---|---|---|---|
| 2,912,694 | 11/1959 | Phillips, Jr. | 343/777 |
| 3,864,536 | 2/1975 | Vaughan et al. | 333/107 |

*Primary Examiner*—Paul L. Gensler

*Attorney, Agent, or Firm*—John Holtrichter, Jr.; William H. MacAllister

[57] ABSTRACT

A two-port-to-three-port waveguide switch comprising two single pole double throw waveguide switches integrated so that one of the terminals of each switch has a common junction.

5 Claims, 8 Drawing Figures

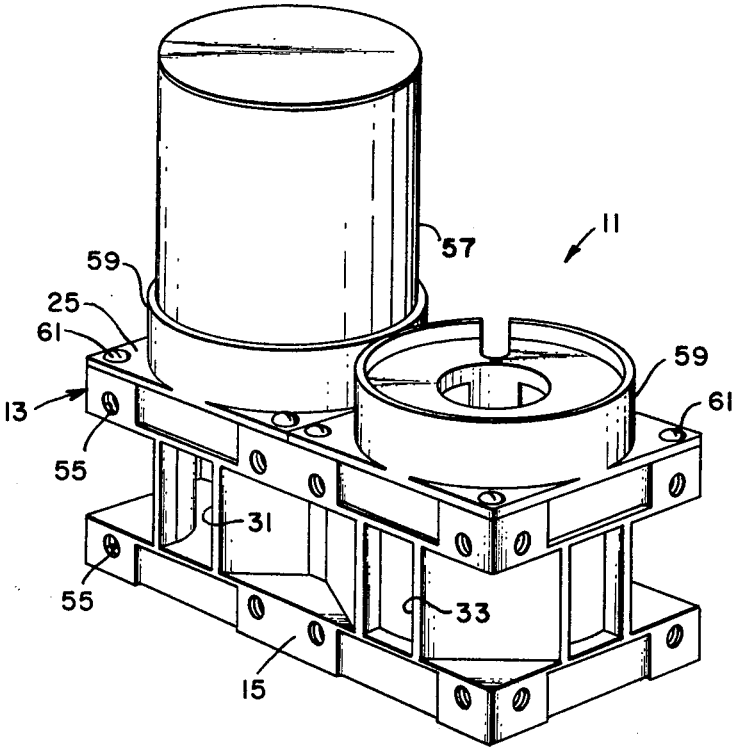
Fig. 1.
Fig. 2.
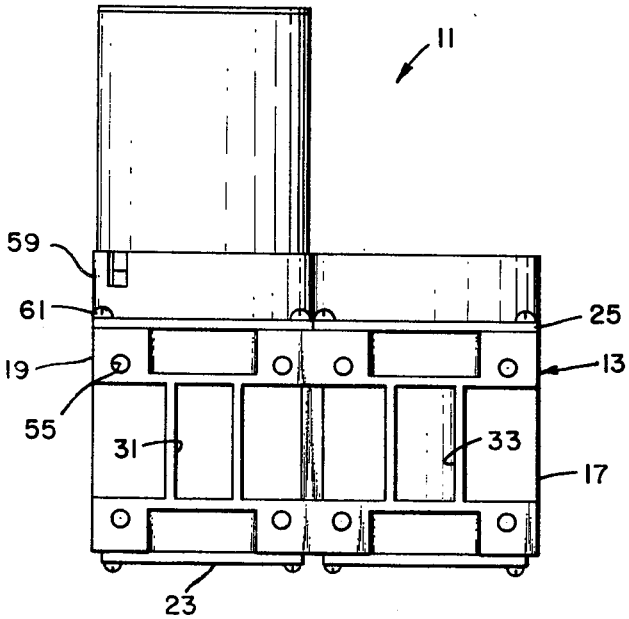
Fig. 3.
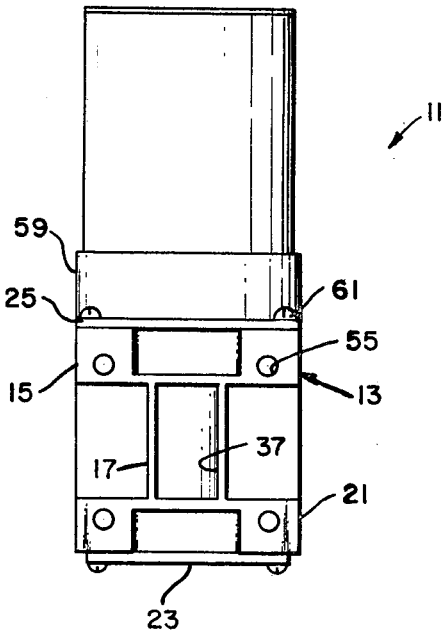

FIVE PORT WAVEGUIDE SWITCH

BACKGROUND OF THE INVENTION

The background of the invention will be set forth in two parts.

1. Field of the Invention

This invention relates to microwave devices and more particularly to waveguide switches.

2. Description of the Prior Art

In microwave systems, it is often desirable to have an electromagnetic wave energy transmission line switch, such as a waveguide switch, which will conduct such energy from a first waveguide section to either a second or to a third waveguide section, or from either the second or third waveguide section to the first waveguide section.

Such switches have been available for quite some time and are generally manually operated or provided with remotely controlled (electromechanical) actuating mechanisms such as motors and rotary or linear solenoids. The waveguide switches generally include a housing incorporating a stator portion and a rotor portion in which one or more waveguide channels are provided. The housing or stator includes appropriate flange connections at the port locations. The rotor can then either be manually or remotely rotated within the stator housing and, depending on the rotor position, the various waveguides connected to the stator flange connections are linked to each other. Electrical continuity between the rotor and stator portions of the switch is generally achieved by means of quarterwave chokes providing high isolation between the rotor waveguide channels.

In most ground-based installations, the prior art waveguide switches admirably fulfill their function. However, in spacecraft applications where space and weight must be kept to an absolute minimum, presently known waveguide switches cannot perform certain necessary functions without adding weight and complexity to the system.

For example, it is necessary to provide back-up capability in the spacecraft most active devices such as traveling wave tubes and other microwave generators since the loss of even a single such device could completely ruin an important space task. Accordingly, in almost all space oriented systems, a redundency system is used whereby a failing or dead device can be bypassed and/or a backup devices switched into the system, either automatically or by ground terminal command.

Current waveguide switches are single pole double throw or transfer devices, the latter allowing each port to be alternately connected to its two adjacent ports. In order to provide the necessary switching in a redundency system, previous waveguide circuits used two separate waveguide switches. It should therefore, be quite evident that a new waveguide switch which eliminates two previously required waveguide switches in every redundency system about a spacecraft and which also enable the shortening of RF transmission lines to reduce transmission line losses, would constitute a significant advancement of the art.

SUMMARY OF THE INVENTION

In view of the foregoing factors and conditions characteristic of the prior art, it is a primary object of the present invention to provide a new and improved waveguide switch.

Still another object of the present invention is to provide a waveguide switch that enables the remote selection of a redundant waveguide terminal as a third port.

Yet another object of the present invention is to provide a five port waveguide switch wherein the third port is common to the switch's two rotors.

Still a further object of the present invention is to provide a five port waveguide switch which integrates two single pole double throw waveguide switches into one switch with one therminal from each switch position having a common junction.

In accordance with one embodiment of the present invention, a five port waveguide switch includes a housing having first and second rotor-accepting cylindrical cavities and first and second ports, the housing also including a third port associated with the first port, a fourth port associated with the second port, and a fifth port selectably associated with either the first port or the second port. First and second rotors are respectively disposed in the first and second cavities. The first rotor is in a first position and providing the path between the first and fifth ports when the first rotor is in a second position, the second rotor having a curved waveguide channel is disposed thereon providing a radio frequency propagation path between the second and fourth ports when the second rotor is in a third position and providing the path between the second and fifth ports when the second rotor is in a fourth position. The invention also includes rotating means operatively coupled to the first and second rotors for selectably moving the rotors between their respective two positions.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

BRIEF DESCRIPTION OF THE DRAWINGS

FIG. 1 is a perspective view of an embodiment of the invention showing three of the five ports and one of the two stepping motors in place;

FIG. 2 is a front elevational view of the waveguide switch of FIG. 1;

FIG. 3 is a side elevational view of the waveguide switch of FIG. 1;

DESCRIPTION OF THE PREFERRED EMBODIMENTS

Figure 4:
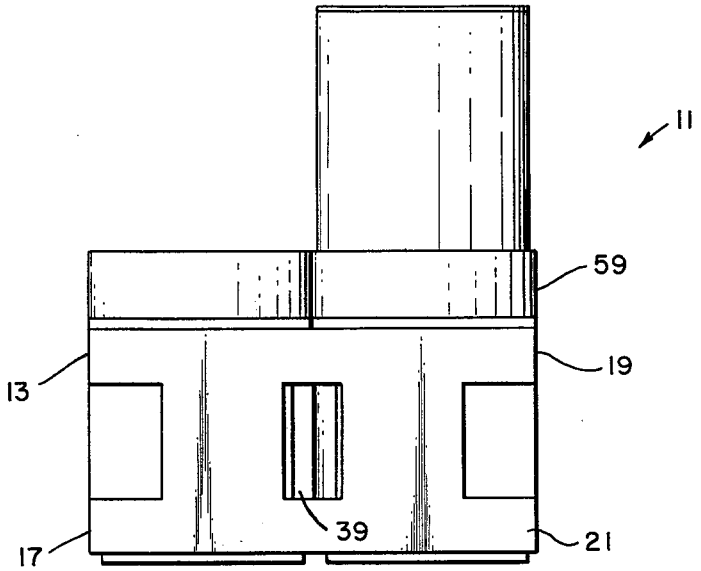
FIG. 4 is a rear elevational view of the waveguide switch shown in FIG. 1.

Referring now to the drawings and more particularly to FIGS. 1–4, there is shown a five port waveguide switch 11 with a cast and machined housing 13 having a front side 15, a right side 17, left side 19, a rear side 21, a lower surface 23, and an upper surface 25.

Figure 5:
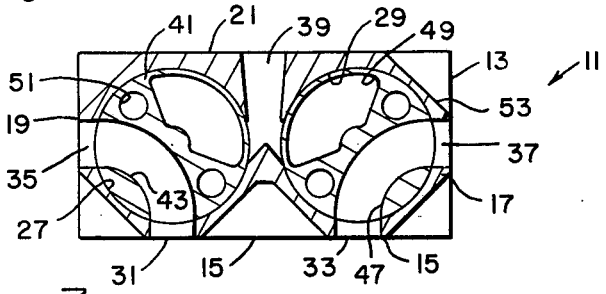
FIGS. 5–7 are sectional views showing the rotors in their associated cylindrical cavities in their three rotor positions.
Figure 6:
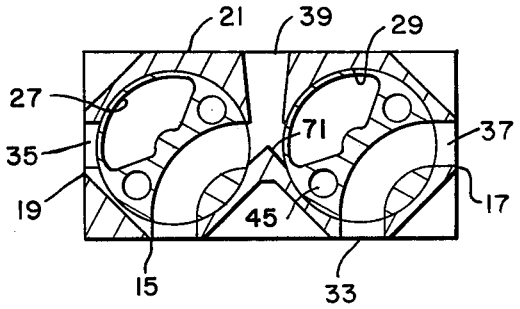
Figure 7:
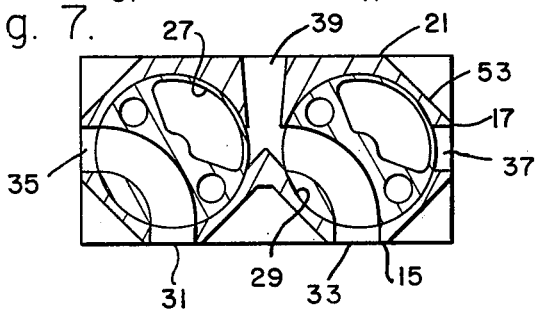

As illustrated in FIGS. 5–7, the housing 13 is provided with first and second rotor-accepting cylindrical cavities 27, 29 and first and second ports 31, 33 respectively communicating with the cavities through the front side 15. The housing also includes a third port 35 in the left side 19, a fourth port 37 in the right 17, and a fifth port 39 in the rear side 21. As will be explained in detail hereinafter, the third port 35 is associated with the first port 31, the fourth port 37 is associated with the second port 33, and the fifth port 39 is selectably associated with either the first port 31 or the second port 33.

Again referring to FIGS. 5–7, a first rotor 41 having a first curved waveguide channel 43 is disposed in the first cylindrical cavity 27, and a second rotor 45 having a second curved waveguide channel 47 is disposed in the second cylindrical cavity 29. In order to balance the rotors and to reduce the weight as much as possible the rotors in this embodiments are milled and drilled as indicated by reference numerals 49 and 51. In this regard, the housing 13 is cast in a manner reducing all necessary weight as will be noted at angled faces 53. Although not shown, conventional flanges are readily attachable to the housing about each of the ports by machine screws anchored in tapped holes 55.

As shown in FIG. 5, when the first rotor 41 is in its first rotor position, the first curved channel 43 allows the propagation of radio frequency energy having a wavelength suitable for the dimensions of the ports and channel to propagate in either direction between the first port 31 and the third port 35, while RF energy may propagate between the second port 33 and fourth port 37 when the second rotor is in its first position.

When the first rotor is rotated to its second position and the second rotor remains in its first position, RF energy may propagate between the first and fifth ports 31,39 and between the second and fourth ports as shown in FIG. 6. Alternately, the first rotor may remain in its first position while the second rotor 45 is rotated to its second position. In this configuration, as illustrated in FIG. 7, the first waveguide channel 43 provides a propagation path between the first and third ports, and the second waveguide channel 47 provides a path between the second port 33 and the fifth port 39.

The rotors may be rotated 90° to their respective two positions by any conventional means such as by manually operated knobs, or by stepper motors 57, for example. The motors are mounted on motor assembly members 59 which are held in place by conventional machine screws conventional bearings and the upper portion of the shaft is coupled to the motor shafts by conventional shaft couplings, as is well known in the art. Also, the coupling can include one or more ratially extending logs which will limit the extent of shaft rotation, where desired.

Figure 8:
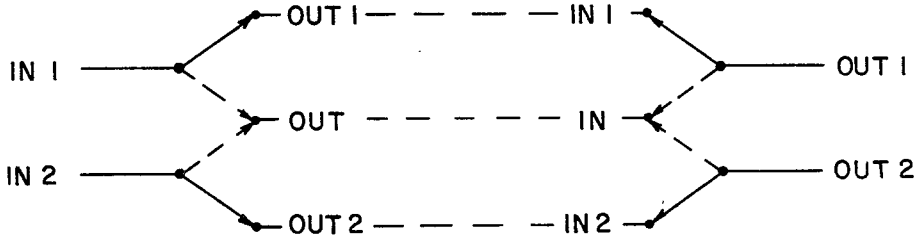
FIG. 8 is a schematic representative of the functional electrical circuit of the waveguide switch illustrated in FIGS. 1–7.

Referring now to the equivalent schematic design of FIG. 8, it can be seen that the basic design concept of the invention integrates two single pole double throw waveguide switches (rotors 41 and 45 and their associated cylindrical cavities and ports). It will be noted that there is a common junction for both switch sections (fifth port 39) which makes it possible to switch a single redundant component into the system. In order to provide good RF characteristics, the common junction is preferably a mitered corner 71, as seen in FIGS. 5–7.

From the foregoing it should be evident that there has herein been described a new and improved five port waveguide switch shich is very compact, light weight, and which efficiently enables the system to select a redundant waveguide terminal as a fifth port.

What is claimed is:

1. A five port waveguide switch comprising:

a housing having first and second rotor accepting cylindrical cavities and first and second ports, said housing having also include a third port associated with said first port, a fourth port associated with said second port, and a fifth port selectably associated with either said first port or said second port;

first and second rotors respectively disposed in said first and second cavities, said first rotor having a curved waveguide channel disposed therein providing a radiofrequency propagation path between said first and third ports when said first rotor is in a first position and providing said path between said first and fifth ports when said first rotor is in a second position, said second rotor having a curved waveguide channel disposed therein providing a radio frequency propagation path between said second and fourth ports when said second rotor is in its first position and providing said path between said second and fifth ports when said path between said second and fifth ports when said second rotor is in its second position; and rotating means operatively coupled to said first and second rotors for selectably moving said rotors between their respective two positions.

2. The waveguide switch according to claim 1, wherein said fifth port is disposed in said housing on a side opposite said first and second ports and lies on a first plane intermediate said first and second ports.

3. The waveguide switch according to claim 2 wherein said third and fourth ports lie in a second plane orthogonal to said first plane and are disposed on opposite sides of said housing from each other.

4. The waveguide switch according to claim 1, wherein said cavities include openings in the cylindrical wall thereof associated with each of said ports, said housing including a wedge portion disposed adjacent said openings associated with said fifth port, the apex of said wedge portion being disposed toward said fifth port.

5. The waveguide switch according to claim 1, wherein said rotating means include two stepper motors, each motor being operatively coupled to a different one of said rotors.

* * * * *